United States Patent [19]

Gongwer

[11] Patent Number: 4,571,192

[45] **Date of Patent: * Feb. 18, 1986**

[54] SELF PROPELLED SPHERICAL VEHICLE

[75] Inventor: Calvin A. Gongwer, Glendora, Calif.

[73] Assignee: Allied Corporation, Morristown, N.J.

[ * ] Notice: The portion of the term of this patent subsequent to Mar. 29, 2000 has been disclaimed.

[21] Appl. No.: 657,102

[22] Filed: Oct. 2, 1984

Related U.S. Application Data

[63] Continuation-in-part of Ser. No. 550,157, Nov. 9, 1983, abandoned.

[51] Int. Cl.[4] ..... B63G 8/08

[52] U.S. Cl. ..... 440/66; 440/81; 114/163; 114/312; 114/338; 114/56; 244/199

[58] Field of Search ..... 440/1, 37, 44, 66, 81, 440/53; 114/162, 163, 56, 312, 338, 330, 331, 332; 244/199

[56] References Cited

U.S. PATENT DOCUMENTS

| | | | |
|---|---|---|---|
| 1,853,890 | 4/1932 | Augner | 440/81 |
| 2,196,706 | 4/1940 | Naginskas | 440/81 |
| 2,433,971 | 1/1948 | Adams | 114/330 |
| 2,914,013 | 11/1959 | Bizjak | 440/37 |
| 3,137,265 | 6/1964 | Meyerhoff | 440/1 |
| 3,442,244 | 5/1969 | Clark et al. | 114/163 |
| 4,377,982 | 3/1983 | Gongwer | 114/56 |
| 4,455,962 | 6/1984 | Gongwer | 114/56 |

FOREIGN PATENT DOCUMENTS

| | | | |
|---|---|---|---|
| 386498 | 10/1968 | U.S.S.R. | 440/80 |

*Primary Examiner*—Trygve M. Blix
*Assistant Examiner*—Stephen P. Avila
*Attorney, Agent, or Firm*—Robert C. Smith; Vett Parsigian

[57] ABSTRACT

A self-propelled spherical vehicle (10) for operation in a fluid medium utilizes an impeller (12) of approximately half the diameter of the sphere for propulsion. In addition to driving the vehicle, the impeller acts to draw the flow of fluid smoothly over the after part of the sphere, thus avoiding or minimizing the tendency of the fluid flow to separate from the surface and create turbulence. Compensation for impeller torque is effected in one embodiment by a series of non-rotating stator blades (14) carried coaxially of and immediately aft of the impeller and which are curved to counter the torque of the impeller on the vehicle. The stator structure is supported at the rear of the housing by brackets (18) including pivotal supports providing support in the vertical plane. Steering in azimuth and/or yaw is effected through pivotal supports (16,16',16'') and actuators and (20, 24, 20', 24', 20'', 24'') operative in the azimuth and/or pitch plane to effect rotation of the stator around the pivotal supports (16,16',16''). In another embodiment impeller torque is compensated for by contra-rotating impellers. In another embodiment impeller torque is compensated for by contra-rotating impellers (42, 44).

11 Claims, 11 Drawing Figures

FIG. 1
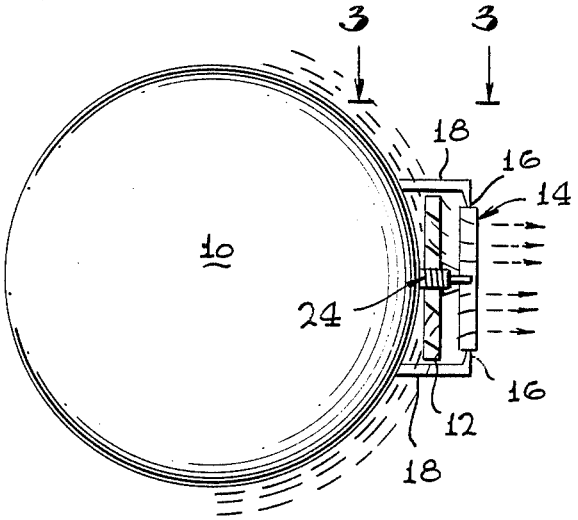
FIG. 2
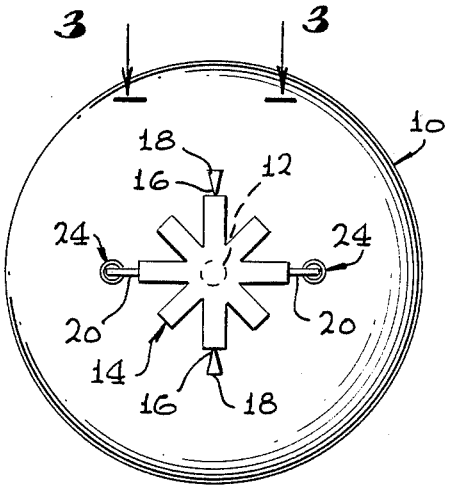
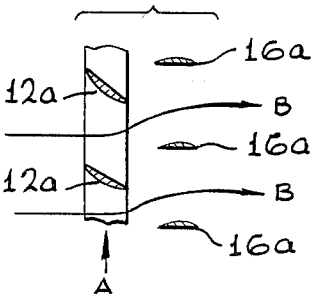
FIG. 5
FIG. 3
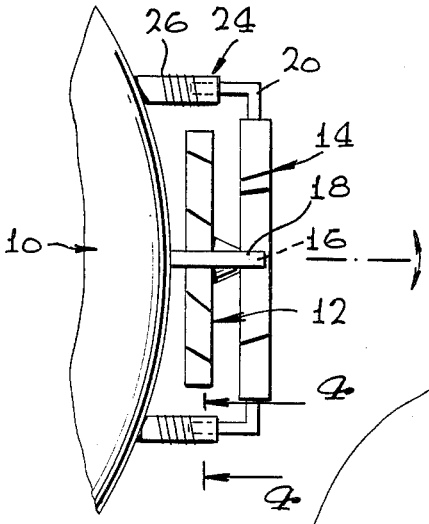
FIG. 6
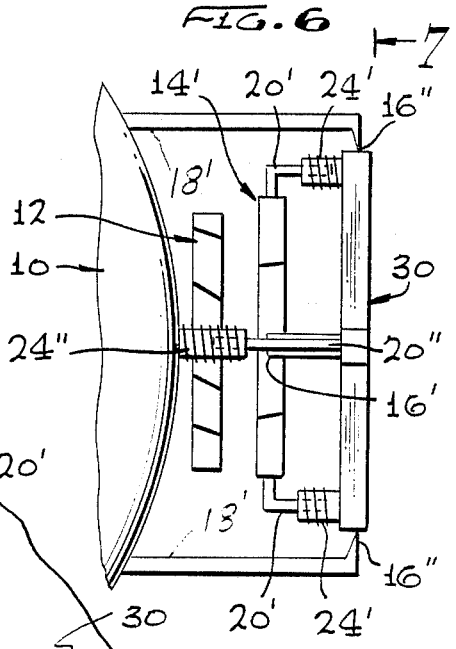
FIG. 4
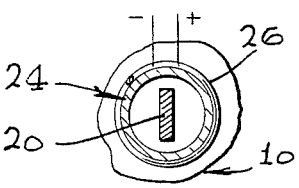
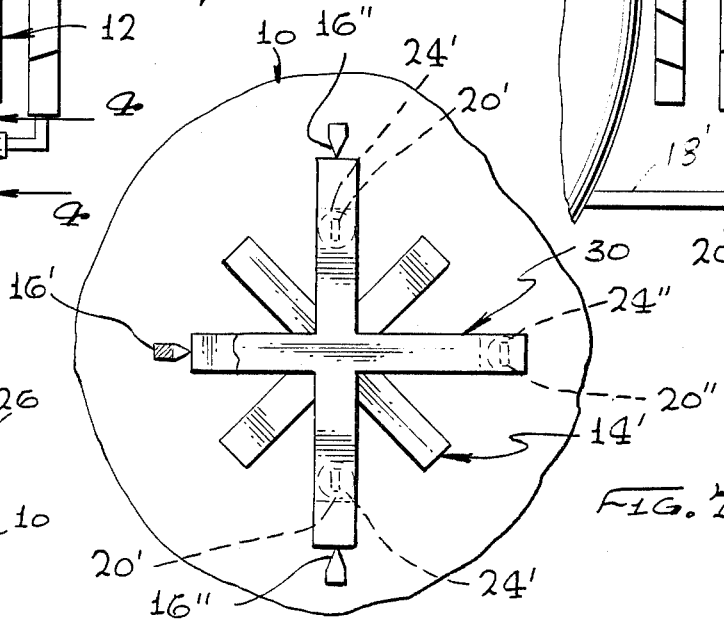
FIG. 7

SELF PROPELLED SPHERICAL VEHICLE

This is a continuation-in-part of application Ser. No. 550,157 filed Nov. 9, 1983, now abandoned.

This invention relates to a self-propelled spherical vehicle for operation in a fluid medium.

It is known to provide a spherical vehicle having a generally spherical housing with an impeller external of the housing for driving the vehicle. A suitable power source is carried within the housing to cause rotation of the impeller which is carried at the rear of the vehicle with respect to its direction of motion. With an impeller of the actuator disk type having a substantial number of blades of short chordal length relative to the diameter of the impeller, said impeller having a diameter which is approximately one-half the diameter of the spherical housing and being spaced a proper distance from the housing, a substantial part of the boundary layer at the rear of the vehicle is inducted into the impeller to reduce drag caused by fluid separation at the surface.

A vehicle like that described above is disclosed in U.S. Pat. No. 4,377,982. The disclosed vehicle relies for steering on a plurality of drag pins located just aft of the circle of maximum diameter of the spherical housing. Impeller torque is compensated for by means of a number of small fins or vortex generators positioned in the fluid stream at the rear of the housing just ahead of the impeller. While these are operative means for accomplishing their desired functions, they have not operated as well as desired, particularly at very slow speeds or at the start. This is because neither the drag pins nor the vortex generators are as effective as might be desired until the vehicle gains sufficient velocity to cause a significant velocity of fluid flow past these members. This has led to a study to provide a more effective means for effecting steering of the vehicle, particularly in the yaw plane and for compensating for the torque of the impeller.

The spherical vehicle of the invention is characterized in that steering and impeller torque compensation are provided by a stator carried just aft of the impeller, coaxially therewith and having a substantial number of radially extending blades of short chordal length relative to the stator diameter which are curved to compensate for impeller torque. The support structure for the stator includes a pivotable mount permitting the stator to be tilted relative to the housing.

According to another feature, the spherical vehicle is further characterized in that the support structure may include pivotable supports in two planes permitting the stator to be tilted to effect steering in either of the pitch or yaw planes.

According to still another feature, impeller torque may be compensated for through the use of contra-rotating impellers with a stator as described above but without the described curvature in the blades to correct for impeller torque.

A principal advantage of the invention is that both impeller torque compensation and steering are much more effective than with the above-described prior art structure. It has been found quite effective to accomplish steering in the pitch plane by means of a pendulum structure carried within the housing. With this arrangement, the stator needs only to be tilted in one plane to effect steering in yaw or azimuth. If no other means are provided for steering in the pitch plane, the support structure for the stator can be designed to tilt the stator in both pitch (elevation) and yaw planes.

The invention will now be described with reference to the accompanying drawings in which:

FIG. 1 is a side elevation of a spherical vehicle according to my invention;

FIG. 2 is a view from the rear of the vehicle of FIG. 1;

FIG. 3 is a partial plan view of the rear portion of the vehicle of FIG. 1 on an enlarged scale;

FIG. 4 is a sectional view taken along line 4—4 of FIG. 3;

FIG. 5 is a schematic diagram showing relative positions of the impeller and stator blades and their effect on flow of the fluid medium;

FIG. 6 is a partial side elevation of a spherical vehicle on an enlarged scale showing another embodiment of my invention;

FIG. 7 is a view from the rear of the embodiment of FIG. 6;

Figure 8:
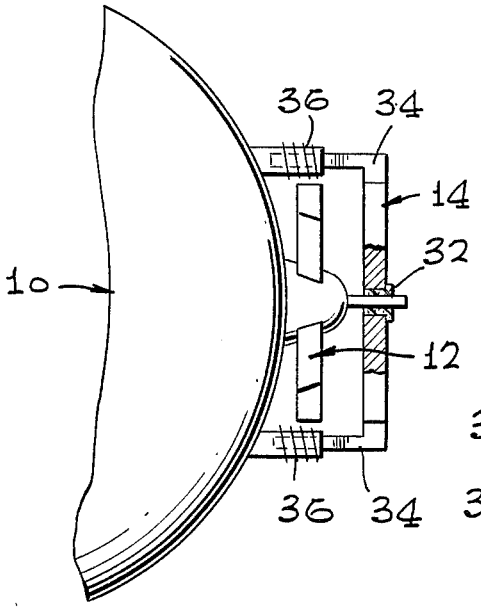
FIG. 8 is a partial side elevation of a spherical vehicle on an enlarged scale showing still another embodiment of my invention.

Referring now to FIG. 1, a spherical vehicle 10 is shown in connection with a flow pattern representing a body of water withinwhich it moves toward the left. An impeller 12 of the actuator disk type having a substantial number of blades of short chordal length is located at the rear which drives the vehicle. While for convenience applicant has shown eight blades on his drawings, sixteen blades is more typical, and this number has been used in applicant's models. The fluid medium could be gaseous (air) and the flow pattern would be similar. The impeller 12 serves to pull the flow pattern toward itself, causing flow to remain smooth and attached to the surface of the sphere until it passes through the impeller. Positioned coaxially with respect to the impeller 12 and directly behind it is a stator 14 which may be on a common axis member but which does not rotate. Stator 14, which preferably is similar in configuration to impeller 12, includes a substantial number of radially extending vanes of short chordal length which are curved to deflect the flow such that it compensates for the torque of the impeller acting on the housing of vehicle 10. Since the stator is directly behind the impeller 12, it immediately receives the flow from the impeller which flow will produce a torque opposite in direction and varying essentially linearly with the impeller torque. This side elevation shows stator 14 supported on pivots 16 at the ends of support brackets 18.

FIG. 2 is a view of the vehicle 10 from the rear showing stator 14. Impeller 12 is directly behind stator 14 and is indicated by the dashed lead line. Stator 14 is shown having two blades or arms 20 of magnetic material extending outwardly and then turned parallel to the axis of impeller 14 such that they are partially carried within the interior of a pair of solenoid members 24. Solenoid members 24 incorporate electrical windings 26 which may be alternately energized to cause one of arms 20 to move inwardly while the other such arm is moved outwardly and vice versa. As these solenoid members are energized, they effectively tilt the stator around its pivots 16 causing the flow discharged from the impeller to be deflected. The reaction force resulting from this deflection will rotate the housing of vehicle 10 around its vertical axis, thus providing steering in yaw. FIG. 3 is a partial plan view on an enlarged scale of the vehicle shown in FIGS. 1 and 2. The arms or extensions carrying solenoids 24 are preferably formed to provide the smallest practicable resistance to flow of water past them. The windings 26 are smoothly faired into the housing and the ends of arms 20 are shown in phantom in the hollow interior of solenoid members 24. Energizing of one or the other of the solenoid windings 24 will cause one arm to move inwardly and the other outwardly, thus tilting stator 14 around pivots 16 and causing it to act like a relatively large and effective rudder, deflecting water flow laterally and turning the vehicle 10 in the yaw plane.

FIG. 4 is a sectional view taken along line 4—4 of FIG. 3. In this view, the solenoid member 24 is shown in section, carrying winding 26. One of arms 20 is shown essentially centered within solenoid member 24 where, upon energizing of winding 26, it can move in a direction normal to the plane of the drawing.

FIG. 5 is a schematic diagram showing relative positions of the impeller and stator blades and their effect on the flow of the water or other fluid medium across them. This diagram shows a plurality of impeller blades 12*a* moving as shown by the arrows adjacent a series of stationary stator blades 16*a*. Movement of the blades 12*a* in direction A tends to deflect the flow of water as shown by the curved arrows B pointing toward the right wherein the flow is first deflected upwardly and then deflected back laterally by the stator blades 16*a*. Movement of the water against the stator blades tends to produce a force (upwardly in this view) opposite in direction and essentially equal to the reaction force on the vehicle 10 caused by rotation of the impeller 12.

A second embodiment of my invention is shown in FIGS. 6 and 7. FIG. 6 is a partial side elevation of the vehicle 10 similar to FIG. 3 except that additional means are provided for tilting the stator in the pitch plane. A cruciform support member 30 is carried on of a pair of pivot members 16″ which terminate support brackets 18′ attached to housing 10. Attached to the end of the vertically oriented arms of support member 30 are a pair of solenoid members 24′. These solenoid members 24′ cooperate with arms 20 which are extensions of oppositely directed vertical blades of stator 14′ to cause the stator to tilt in the pitch plane. Attached to the horizontal arms of support member 30 are arms 20″ which serve to carry pivot members 16′ and as armatures extending within the hollow cores of armatures 24″. Energizing of one or the other of armatures 24″ will cause the entire stator assembly to pivot around pivot 16″, thus tilting the stator in azimuth and causing the housing 10 to be turned in the yaw plane. FIG. 7 shows armature 24″ and arm 20″ in phantom behind the right arm of member 30. Armatures 24′ and arms 20′ are shown in phantom behind the vertically extending arms of member 30. The left arm of member 30 is shown broken away to disclose a portion of pivot member 16′ which has a counterpart behind the right arm of member 30. The stator 14′ is pivotable around members 16′ when one or the other of solenoids 24′ is energized. Pivot members 16′ may conveniently be formed as parts of member 20″.

Figure 9:
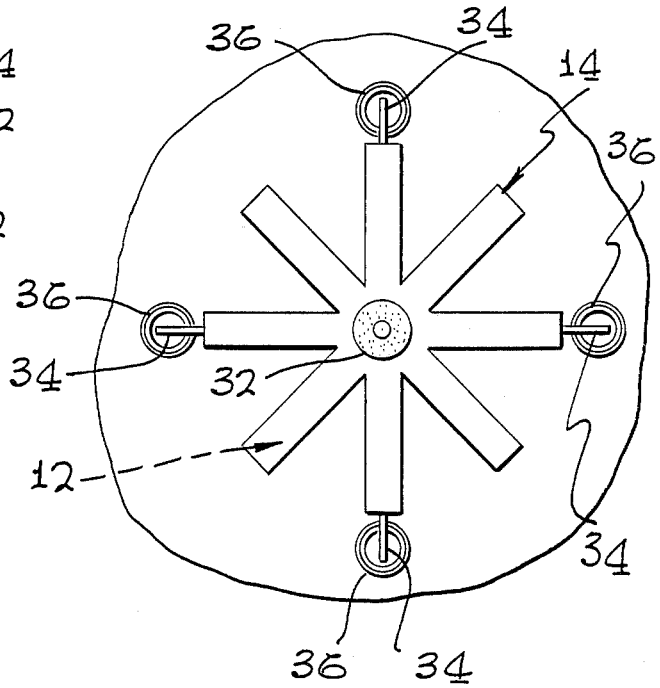
FIG. 9 is a view from the rear of the embodiment of FIG. 8.

FIGS. 8 and 9 show a third embodiment of my invention in which the stator is movable in either the yaw or pitch planes. In this embodiment the stator 14 is also carried on an extension of the shaft on which impeller 12 rotates, it is coaxial with and directly behind the impeller. Stator 14 in this case is supported on a flexible rubber bushing or bearing 32 which is sea water lubricated and which permits the stator 14 to be tilted on its support shaft. Blades of the stator which are oriented ninety degrees apart, that is, top and bottom and at both sides, are extended radially to form arms 34, essentially as shown, similar to arms 20 of FIG. 3. These arms extend into the interior of solenoid windings 36 which are faired into rearwardly extending supports which may be essentially the same as shown in FIG. 3.

FIG. 9 shows the structure of FIG. 8 as seen from the rear. In this view all four of arms 34 and the rearwardly extending supports which carry solenoid windings 36 are shown. Also visible is the face of stator 12 and the rubber bushing 32.

Figure 10:
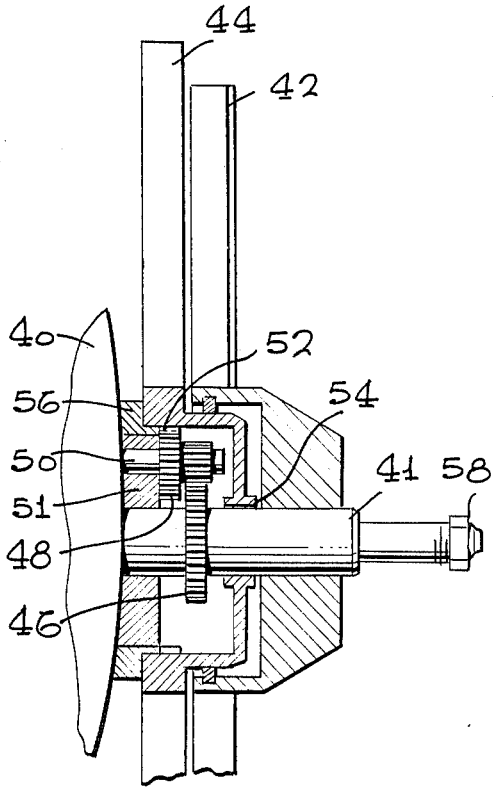
FIg. 10 is a partial side elevation of a spherical vehicle on an enlarged scale showing a further embodiment of my invention.
Figure 11:
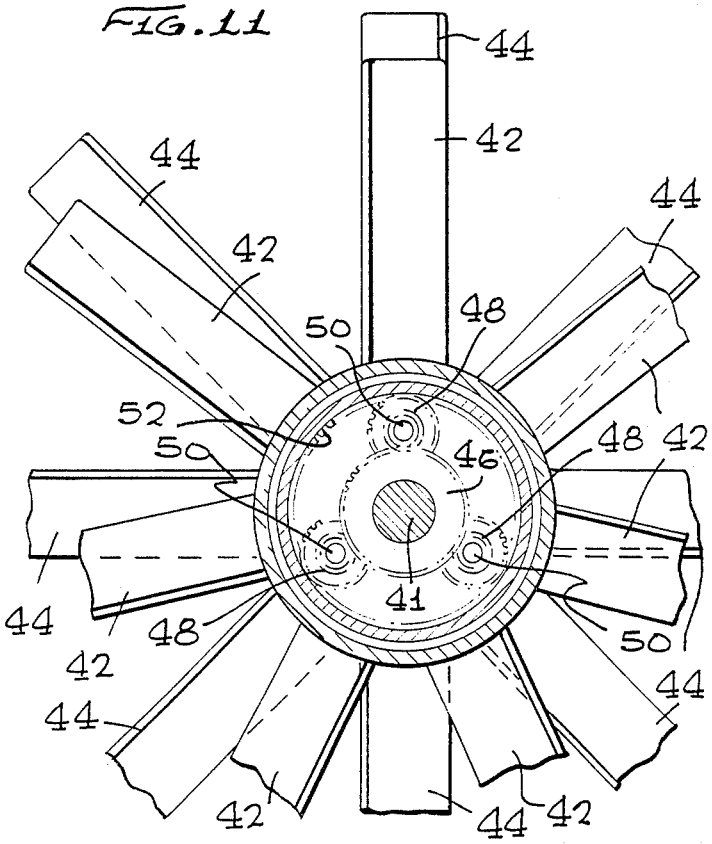
FIG. 11 is a view from the rear of the embodiment of FIG. 10.

FIG. 10 is a side elevation of a spherical vehicle showing another arrangement for driving the vehicle and for compensating for impeller torque. In this embodiment a single output shaft 41 is driven by the internal powr source including a directly connected impeller member 42 at the rear and a second, forward impeller member 44 which is driven from shaft 41 through planetary gear arrangements including a drive gear 46, a plurality of stepped planetary gears 48 driven by gear 46 which rotate on stationary pins 50 carried at the rear of the housing of vehicle 40 on supports 51 and which drive a ring gear 52 forming part of impeller member 42. Carbon bearings 54 and 56 support impeller 44 and permit relative movement between shaft 41 and impeller member 44 and between the supports 51 and impeller 44, respectively. To provide lubrication between rotating shaft 41 and a stationary shaft upon which it is carried, a conventional fitting 58 may be incorporated to permit the entry of lubricant. Any of the above-described stators and stator actuators may be used with the contra-rotating impeller structure of FIGS. 10 and 11, but would not include the curved blades to compensate for impeller torque since this is inherent in the contra-rotating impeller concept.

While the present invention has been described herein in connection with four embodiments, modifications within the scope of the present invention will be apparent to those skilled in the art. The solenoid actuating means for steering is quite simple to implement and has the advantage of avoiding sealing problems from operating actuating rods through one or more sizeable holes in the wall of the housing since only wires need to pass through the wall. Alternatively, if such sealing problems are considered acceptable, actuating rods controlled by electrical or hydraulic actuators could be used for tilting the stator. The stator can be protected in shipping and handling by essentially the same packing or protective structure used to protect the impeller. Where appropriate a weighted spin-off shroud such as that shown in copending application Ser. No. 463,434, now U.S. Pat. No. 4,455,962 can be employed as a protective device.

I claim:

1. A self-propelled spherical vehicle for operation in a fluid medium comprising a generally spherical housing and an impeller external of said housing at the rear of said vehicle with respect to its direction of motion, an energy source and power means in said housing connected to cause rotation of said impeller, said impeller being of the actuator disk type having a substantial number of radially oriented blades having a short chordal length relative to the diameter of said impeller and adjacent said housing and approximately one-half the diameter of said housing and spaced such that the maximum circle of rotation of said impeller is approximately seven percent (7%) of the diameter of said spherical housing from the surface of said housing such that it inducts a substantial part of the boundary layer at the rear of the vehicle to thereby reduce the drag on the vehicle caused by separation of the fluid over its surface, characterized in that steering means are carried at the rear of said housing comprising a stator having a substantial number of radially extending blades and having a short chordal length located immediately aft of and coaxially of said impeller, support means attached to said stator and to said housing, pivot means forming part of said support means, and actuating means for causing said stator to turn on said pivot means, said actuating means including radially extending members located approximately at right angles to said pivot means, and control means for moving said radially extending members to pivot said stator.

2. A self-propelled spherical vehicle as set forth in claim 1 wherein said support means includes members positioned substantially on the horizontal axis and the vehicle axis with respect to the direction of movement of said vehicle, and pivotal means are incorporated into said members on one of said axes to permit tilting of said stator, and actuator means are incorporated into said members on the other of said axes to tilt said stator to effect steering of said vehicle in one of the azimuth and elevation planes.

3. A self-propelled vehicle as claimed in claim 1 wherein said control means incorporates arms extending rearwardly from said housing, solenoid winding means incorporated into each of said arms and armature members formed with said radially extending members which are magnetically linked with said solenoid winding means.

4. A self-propelled vehicle as set forth in claim 2 wherein said actuator means comprises a solenoid structure incorporated into said support means including electrical windings incorporated into extending brackets and armature means formed as an extension of stator blades normal to said pivotal axis and movable upon energizing of said windings to rotate said stator around said one axis.

5. A self-propelled spherical vehicle as set forth in claim 1 wherein said support means includes rearwardly extending arms carrying pivot members, a second support member arranged to pivot on said pivot members with said actuating means including first solenoid means operatively attached to drive said second support member around said pivot members, second solenoid means being carried on said second support member, and radially extending members attached to said stator member cooperating with said second solenoid means to cause said stator member to pivot on an axis perpendicular to the axis of said pivot members.

6. A self-propelled spherical vehicle as set forth in claim 1 wherein said impeller includes a pair of contra-rotating actuator disk members carried on the same axis, one of which is driven through a planetary gearset carried on the same drive shaft which drives the other, and the rearward actuator disk member has a slightly smaller diameter and one less blade than the forward actuator disk member.

7. A self-propelled spherical vehicle as set forth in claim 1 wherein said impeller includes a drive shaft and a pair of contra-rotating actuator disk members are carried on the same shaft.

8. A self-propelled spherical vehicle as set forth in claim 7 wherein the rearward of said actuator disk members has a slightly smaller diameter and one less blade than the forward actuator disk member.

9. A self propelled spherical vehicle as set forth in claim 7 wherein one of said actuator disk members is directly driven on said shaft, a planetary gearset is driven from said shaft, and the other of said actuator disk members is driven through said planetary gearset.

10. A self-propelled spherical vehicle as set forth in claim 1 wherein said stator is attached to said housing through a flexible bearing member and said support means includes members positioned substantially on the horizontal axis and the vertical axis with respect to the direction of movement of said vehicle, and actuator means are incorporated into said members to tilt said stator in either of said azimuth and elevation planes.

11. A self-propelled spherical vehicle for operation in a fluid medium comprising a generally spherical housing and an impeller external of said housing at the rear of said vehicle with respect to its direction of motion, an energy source and power means in said housing connected to cause rotation of said impeller, said impeller being of the actuator disk type having a substantial number of radially oriented blades having a short chordal length relative to the diameter of said impeller and adjacent said housing and approximately one-half the diameter of said housing and spaced such that the maximum circle of rotation of said impeller is approximately seven (7%) percent of the diameter of said spherical housing from the surface of said housing such that it inducts a substantial part of the boundary layer at the rear of the vehicle to thereby reduce the drag on the vehicle caused by separation of the fluid over its surface, characterized in that steering and impeller torque compensating means are carried at the rear of said housing comprising a stationary shaft, a drive shaft coaxial with said stationary shaft, a stator having substantial number of radially extending blades having a short chordal length located aft of said impeller, a flexible bearing carrying said stator on said stationary shaft, a planetary gearset is driven by said drive shaft, said impeller including a pair of contra-rotating actuator disk members carried on said drive shaft, one of which is driven by said planetary gearset, the rearward actuator disk member having a slightly smaller diameter and one less blade than the forward actuator disk member, and actuating means for causing said stator to tilt on said flexible bearing including radially extending members positioned on stator blades substantially on the horizontal and vertical axes with respect to the direction of movement of said vehicle, and support means extending rearwardly of said housing and actuator means incorporated into each of said support means cooperating with said radially extending members to tilt said stator to effect steering of said vehicle in one of the azimuth and elevation planes.

* * * * *